US005792565A

United States Patent [19]

Cupolo et al.

[11] Patent Number: 5,792,565

[45] Date of Patent: Aug. 11, 1998

[54] MULTIPLE LAYERED ARTICLE HAVING A BRIGHT COPPER LAYER

[75] Inventors: Dennis A. Cupolo, Suffern, N.Y.; Robert J. Teichmann, Towaco, N.J.; Ramona Cardona-Grajales, Aguadilla, Puerto Rico

[73] Assignee: Avon Products, Inc., New York, N.Y.

[21] Appl. No.: 733,865

[22] Filed: Oct. 18, 1996

[51] Int. Cl.[6] ..... B32B 15/20; C25D 3/38

[52] U.S. Cl. ..... 428/670; 428/672; 428/673; 428/674; 428/935; 205/182

[58] Field of Search ..... 428/670, 675, 428/673, 672, 671, 674, 935; 205/182

[56] References Cited

U.S. PATENT DOCUMENTS

| | | | |
|---|---|---|---|
| 2,608,753 | 9/1952 | Mooradian | 428/671 |
| 2,646,616 | 7/1953 | Davignon | 428/669 |
| 2,897,584 | 8/1959 | Schumpelt | 428/670 |
| 3,162,512 | 12/1964 | Robinson | 428/670 |
| 4,917,967 | 4/1990 | Cupolo et al. | 428/669 |
| 5,436,082 | 7/1995 | Mathew | 428/675 |

*Primary Examiner*—John J. Zimmerman

*Attorney, Agent, or Firm*—Ohlandt, Greeley, Ruggiero & Perle

[57] ABSTRACT

A unique multi-layered coating process that includes coating the base metal with a layer of strike copper, a subsequent layer of bright copper, a barrier layer of palladium or related element, and a thin surface layer of a precious metal such as gold. The bright copper layer is produced by a special acid copper bath.

10 Claims, 1 Drawing Sheet

MULTIPLE LAYERED ARTICLE HAVING A BRIGHT COPPER LAYER

The present invention relates generally to articles having multiple layers of metal. More particularly, the present invention relates to costume jewelry or other articles having a substrate that is coated with a plurality of layers of metal including a bright copper layer. The preferred present invention includes a substrate or base, preferably of metal, electroplated with, in succession, an improved bright copper layer, a palladium or other barrier layer, and a finishing layer of gold or other precious metal.

BACKGROUND OF THE INVENTION

In the manufacture of useful multiple-layered metallic articles, such as costume jewelry, for example, it is common to first form a base metal, usually tin or brass, into a desired shape by stamping or casting, and then apply by the known technique of electro-deposition or electroplating layers of metal or metal alloy to form the finished piece. Usually a layer of copper is applied directly over the base metal to give the piece ductility and provide a good adhering surface for the plating of a subsequent layer or layers of material. However, this copper layer typically has a dull finish. Therefore, a coating of nickel is then applied to provide the desired brightness to the article, as well as to provide corrosion resistance.

However, nickel will undergo ion migration to the surface of the finished article due to porosity in the precious metal finish or intergranular diffusion of the nickel through the precious metal finish. This migration causes many consumers who wear jewelry having such a nickel layer to suffer adverse allergic reactions. Specifically, it is well known that many people have skin that is sensitive to nickel, and it is not uncommon for such sensitive people to endure skin irritation, itching, reddening or flaking of the skin in the region, such as a wrist or ear lobe, where the costume jewelry comes into contact with the wearer.

U.S. Pat. No. 4,917,967 to Cupolo et al., owned by the assignee of the present invention and having some common inventors, provides one solution to this problem. Instead of the traditional problematic nickel layer, the patent provides a combination of a bronze "brightening layer" followed by a barrier layer of palladium or other such material. The teachings of this patent are herein incorporated by reference. The disadvantages associated with this method are the inherent cost of the bronze layer and its coating process, and the generation of waste from the bronze coating process.

Since the issuance of that patent, the present inventor has discovered a unique copper plating bath that produces a very bright finish previously unknown in the copper plating art. In addition, this copper plating bath can be used with low cost barrel plating techniques not previously available for copper plating. Thus, a bright copper layer can now be provided in place of the bronze "brightening layer" of the Cupolo et al. patent. The palladium or other barrier layer and the precious metal finish are then applied. The present layering structure avoids the allergenic problems created by the prior nickel layer. In addition, it is more economical and produces fewer potentially harmful by-products than the bronze plating method.

SUMMARY OF THE INVENTION

It is an object of the present invention to provide a nickel-free decorative object.

It is a further object of the present invention to provide a non-allergenic product that has a bright finish which is free of a bronze layer, thereby improving economy and lowering environmentally harmful by-products of the coating process.

It is a further object of the present invention to provide a unique multi-layer coating process that allows an intermediate bright copper layer to be barrel coated on the base object.

It is yet a further object of the present invention to provide a multi-layered coating that includes a base, a bright copper layer, a palladium or other layer, and a surface precious metal layer for use in decorative objects such as, for example, jewelry.

Accordingly, the present invention provides a unique multi-layered coating process that includes coating the base with a layer of strike copper, a subsequent layer of bright copper, a barrier layer of palladium or other related element or alloy, and a thin surface layer of a precious metal such as gold.

DESCRIPTION OF THE PREFERRED EMBODIMENTS

Figure 1:
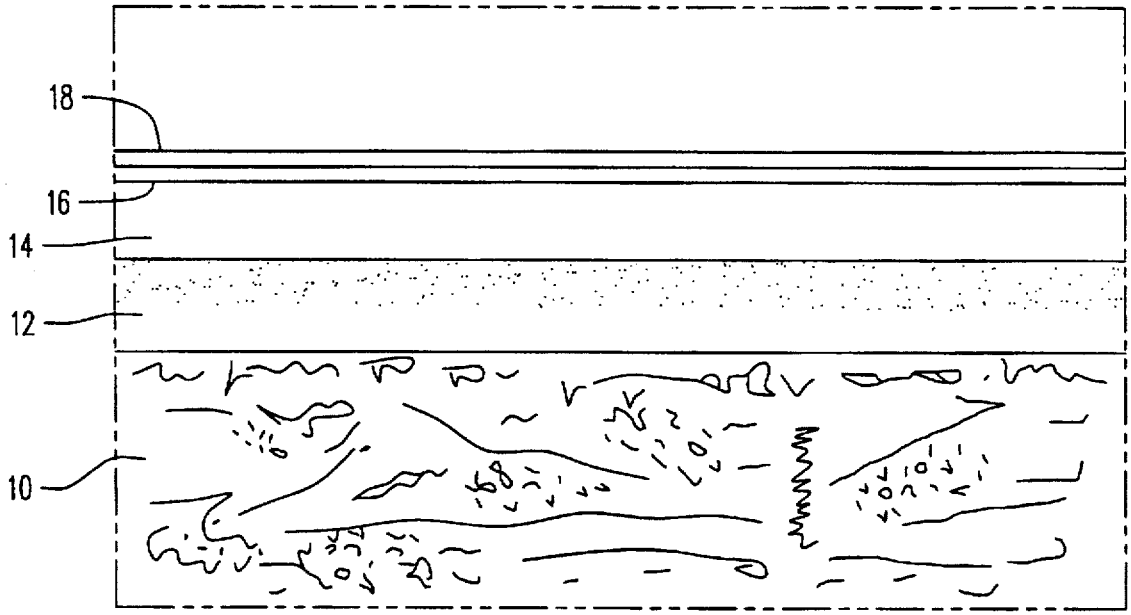
FIG. 1 is an artist's rendering of a photomicrograph (enlarged 1000 times) depicting a preferred embodiment of a multiple-layered article made in accordance with the present invention.

FIG. 1 depicts a partial cross-section of a preferred coating according to the present invention. A base or substrate 10 is made preferably of conventional brass alloy or tin alloy. However, the substrate can be a plastic material. Preferably, the base or substrate should have a thickness of about 1.3 micrometers (0.050 inches) when it is formed into a desired shape by conventional stamping, or any suitable thickness if formed by casting. For example, substrate 10 may be formed into a decorative shape suitable for use as costume jewelry, that is, jewelry having only a small precious metal content so as to be affordable.

The surface of substrate 10 is relatively rough, pitted and unsuitable for directly receiving a coating of precious metal. Accordingly, a strike copper layer is applied to substrate 10 by electroplating in a bath of copper cyanide (CuCN) electrolytic bath. The strike copper layer is preferably plated according to the Cupralite cyanide copper plating process of Enthone-OMI. The thickness of the resultant strike cyanide copper layer 12 will be in the range of 0.3 to 7.6 micrometers (10 to 300 microinches), and preferably, 1.3 micrometers. The resultant layer 12 serves as a surface to receive a second or bright copper layer 14.

Bright copper layer 14 gives the object ductility, as well as the bright finish desired for the proper decorative appearance. This bright finish is achieved by the smooth, flat surface that results from the bright copper layer 14 of the present invention. Thus, bright copper layer 14 can be referred to within the context of the present invention as the "brightening layer." The most preferred depth of the bright copper layer 14 is approximately 13 micrometers (500 microinches).

There are two preferred methods or processes for plating the bright copper layer 14. These processes are the Cubath BBL acid copper barrel electroplating process and the UBAC EP bright acid copper process for rack plating, both of Enthone-OMI (LeaRonal Incorporated, Atotech and Technics, among others, also provide bright copper plating systems).

The Cubath BBL Acid copper barrel electroplating process is dye-free. It can be used for either rack or barrel plating, and produces a very bright, thick, even and durable bright copper layer. It is suitable for use on small objects and is tolerant of metallic impurities. The Cubath BBL Acid copper bath comprises about 67.5 to about 90 grams per liter (also referred to as "g/L") of copper sulfate pentahydrate and about 150 to 225 g/L of concentrated sulfuric acid. The plating bath also includes about 0.05 to 0.08 g/L of chloride ion. The bath is maintained at a temperature of about 24° C. to about 30° C. Cathode and anode current densities of about 0.6 to about 1.2 ASD (amps per square decimeter)(about 6 to about 12 amps per square foot) are applied to the bath, maintaining a tank voltage of about 1 to about 4 volts. The process is controlled by surface tension.

One preferred process for rack plating is the UBAC EP bright acid copper bath. It produces a brilliant, workable and level bright copper layer. Stable brightener additives are used to improve quality. The UBAC EP bath includes about 180 to about 240 g/L of copper sulfate pentahydrate, about 45 to about 75 g/L of concentrated sulfuric acid, and about 0.04 to about 0.08 g/L of chloride ion. The proprietary maintenance solution of this bath ("EP maintenance"), as discussed below, is a key component of the claimed invention. The bath is continuously filtered and vigorously air agitated. The temperature is maintained at about 21 to about 32° C. Current densities of 1.5 to 6 ASD (15 to 60 amps per square foot) and voltage of 3 to 9 V are applied.

Most preferably, the foregoing acid copper baths use live bath entry and controlled current density to attain maximum brightness. Direct cathodic current is attached to the workpiece so that electroplating starts immediately and the deleterious corrosive effects of the bath are mitigated. The optimal current density is the maximum current that can be used without causing burning of the object itself is used. The optimal current density depends on the copper concentration and temperature. The preferred thickness of the bright copper layer 14 is approximately about 7.6 to about 76.2 micrometers (300 to about 3,000 microinches). However, about 25.4 micrometers (1,000 microinches) or greater may not be cost effective.

In addition, optimal palladium or palladium/cobalt barrier layer thickness is a minimum of approximately 0.18 micrometers (7 microinches) for the acid copper based systems. This is necessary to prevent tarnishing caused by the diffusion of copper to the outer surface.

An optimized bright copper bath is used to plate the decorative item. This optimized copper bath employs a modified brightener, containing a mixture of a major amount of the brightener of the BBL with a trace amount of the UBAC EP maintenance. The "maintenance" is a proprietary solution used to maintain working volume in an existing bath as that volume is depleted during plating. In the Material Safety Data Sheet ("MSDS") for the EP maintenance, the vendor discloses the potentially hazardous ingredients of the EP maintenance to be: less than 10% sulfuric acid, less than 1% ethanol, less than 0.1% formaldehyde and greater than 85% water. The MSDS further states that the remainder of the ingredients of the EP maintenance, which are not disclosed, are not known to be hazardous. In addition, it states that the EP maintenance has a specific gravity of 1.057, a pH of less than 1.0, a boiling point of 214° F., a melting point of 32° F., complete solubility in water, a dark blue color and no distinct odor.

The MSDS for the BBL brightener, Cubath BBL 6192, discloses that its potentially hazardous ingredients are sulfuric acid at <10%, ethanol at <1%, formaldehyde at <0.1% and that it contains >85% water. The MSDS further states that the remainder of its ingredients are not known to be hazardous. The BBL brightener is further disclosed as having a specific gravity of 1.044, a pH of <1.0, a boiling point of 214° F., a melting point of 32° F., complete solubility in water, no distinct odor and the appearance of a dark blue liquid. The preferred range is from approximately 0.002% to approximately 0.1% UBAC EP maintenance. The optimal ratio is approximately 99.2% BBL brightener to approximately 0.8% UBAC EP maintenance. As a percentage of the bath, the BBL brightener is approximately 0.25% to approximately 0.75%. The EP maintenance is approximately 0.004 to approximately 0.05%. The optimal combination for barrel plating is 0.496% BBL brightener and 0.004% EP maintenance as a weight percent of total bath weight. Additional supplemental brighteners can be added to this formulation. This improved brightener insures that the finished item is pleasingly bright despite the absence of nickel.

A barrier layer 16 of palladium or other metal or metal alloy, such as, for example, palladium/cobalt alloy or other palladium alloys, platinum or rhodium, is then applied by a suitable electrolytic bath, with the barrier layer being relatively thin in relation to the bright copper layer. The most preferred barrier layers are palladium or a 80/20 palladium/cobalt alloy.

The purpose of the barrier layer 16 is to prevent any solid phase migration of copper to the surface of the object which, if left unimpeded, would ultimately result in tarnishing, as the copper would oxidize on the surface. Accordingly, non-tarnishing metals are preferred for use in the barrier layer 16. Such metals include palladium, palladium/cobalt, other palladium alloys, rhodium and platinum. Palladium is particularly preferred because it is relatively easy to handle and control during plating, has excellent tarnish resistance, and is relatively inexpensive. Palladium may be electroplated over the bright copper layer 14 by immersing the object in an electrolytic bath of palladium. The barrier layer 16 is preferably in the range of about 0.13 to about 0.51 micrometers (5 to about 20 microinches) thick.

Furthermore, the metal selected for barrier layer 16 cannot cause an allergic response itself. This would, of course, defeat the purpose of the "barrier" layer and of the hypo allergenic design of the present invention. Accordingly, cobalt, which otherwise has desirable barrier layer properties, is not a suitable choice. Cobalt is known to induce allergic responses in some wearers when worn in contact or in proximity to the skin. However, palladium/cobalt alloys do not cause allergic response, and as such are suitable for use in barrier layer 16.

Nickel and cobalt are close on the atomic table, and accordingly the palladium/cobalt alloy was tested for potential "cross-over" allergic reaction. Test results showed that while cobalt at high levels does cause reactions, the 80/20 alloy effectively binds the cobalt so that it can not be leached out and is not available to cause reactions with sensitive skin. The preferred palladium/cobalt alloy for use in an embodiment of the present invention is preferably delivered by the Sel-Rex Decorex 2800 bath provided by Enthone-OMI. Other vendors of suitable palladium/cobalt alloys include LeaRonal and Lucent Technologies.

A final, surface layer 18 of precious metal of approximately 0.025 to 0.13 micrometers (1 to approximately 5 microinches) is applied to the object by deposition or electroplating. Generally, surface layer 18 will be applied as a "strike" or "flash" having a thickness of about 0.025 to 0.13 micrometers (1 to about 5 microinches). Alternatively, the barrier layer 16 may also constitute the surface layer 18 when, for example, rhodium or platinum is used.

It will be obvious to one of ordinary skill in the art that the foregoing description and drawing are merely illustrative of certain preferred embodiments of the present invention, and that various obvious modifications can be made to these embodiments in accordance with the spirit and scope of the appended claims.

What is claimed is:

1. A substantially bronze-free multiple-layered metallic article comprising:

a base;

a first layer of bright copper over said base;

a second, barrier layer over said bright copper layer, said second layer being made of a material selected from the group consisting of palladium, palladium alloys, platinum and rhodium; and a third, surface layer over said second layer, said third layer being made of precious metal selected from the group consisting of gold, silver, palladium, palladium alloys, rhodium, platinum, and mixtures thereof, wherein said bright copper layer is produced by a substantially cyanide-free acid copper bath containing BBL brightener and EP maintenance.

2. The article of claim 1, further comprising a layer of strike copper between said base and said first layer.

3. The article of claim 1, wherein said base is made of a metal.

4. A process for producing a substantially bronze-free multiple-layered metallic article, said process comprising:

applying a first layer of bright copper to a pre-formed base object;

applying a second, barrier layer over said first bright copper layer, said second layer being made of a material selected from the group consisting of palladium, palladium alloys, platinum and rhodium; and applying a third, surface layer over said second layer, said third layer being made of precious metal selected from the group consisting of gold, silver, palladium, palladium alloys, rhodium, platinum, and mixtures thereof, wherein said first bright copper layer is produced by a substantially cyanide free acid copper bath containing BBL brightener and EP maintenance.

5. The process of claim 4, further comprising applying a layer of strike copper to said base metal object prior to applying said bright copper layer.

6. The process of claim 4, wherein said bright copper layer is applied by barrel-coating.

7. The process of claim 4, wherein said EP maintenance is present at approximately 0.002% to approximately 0.1% UBAC by weight as a percent of total brightener weight.

8. The process of claim 4, wherein a weight ratio of approximately 99.2% BBL brightener to approximately 0.8% UBAC EP maintenance is used.

9. The process of claim 4, wherein said BBL brightener is approximately 0.4 to 1.0% by weight of total bath and said EP maintenance is approximately 0.004 to 0.05% by weight of total bath.

10. The process of claim 4, wherein said bath includes live bath entry.

* * * * *